US007391995B2

(12) United States Patent
Fujioka

(10) Patent No.: US 7,391,995 B2
(45) Date of Patent: Jun. 24, 2008

(54) DEVELOPING APPARATUS FOR PREVENTING POWDER SCATTERING

(75) Inventor: Ryota Fujioka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 335 days.

(21) Appl. No.: 11/281,397

(22) Filed: Nov. 18, 2005

(65) Prior Publication Data

US 2006/0120760 A1 Jun. 8, 2006

(30) Foreign Application Priority Data

Dec. 6, 2004 (JP) ..... 2004-352496

(51) Int. Cl.
*G03G 15/01* (2006.01)
*G03G 15/08* (2006.01)

(52) U.S. Cl. ..... 399/227; 399/254; 399/258

(58) Field of Classification Search ..... 399/227, 399/254–256, 258, 260
See application file for complete search history.

(56) References Cited

U.S. PATENT DOCUMENTS 6,192,211 B1 * 2/2001 Kimura ..... 399/227
6,823,153 B2 11/2004 Ueno et al. ..... 399/103
7,110,702 B2 * 9/2006 Tomono et al. ..... 399/227
7,233,756 B2 * 6/2007 Tamura ..... 399/227

FOREIGN PATENT DOCUMENTS

JP 2003-107859 4/2003
JP 2003-215917 7/2003

* cited by examiner

*Primary Examiner*—William J Royer
(74) *Attorney, Agent, or Firm*—Fitzpatrick, Cella, Harper & Scinto

(57) ABSTRACT

A developing apparatus of this invention includes development units each including a developing powder accommodating unit for accommodating developing powder, a screw which agitates and conveys developing powder and a developing powder bearing member which bears developing powder to develop an image and a developing powder supply unit which supplies developing powder to the developing powder accommodating unit and develops an electrostatic latent image formed on an image bearing member at a development position. The developing powder supply unit supplies developing powder to a lower area than a screw in the vertical direction of the developing powder accommodating unit in the time the development unit has been in the developing position.

9 Claims, 7 Drawing Sheets

DEVELOPING APPARATUS FOR PREVENTING POWDER SCATTERING

BACKGROUND OF THE INVENTION

1. Field of the Invention

The present invention relates to a developing apparatus for developing an image with developing powder and more particularly to a developing apparatus capable of preventing scattering of the developing powder when the same developing powder is supplied.

2. Description of the Related Art

As a conventional developing apparatus which visualizes an electrostatic latent image by applying developing powder to the same electrostatic latent image, for example, a structure shown in FIG. 7 has been well known.

This developing apparatus includes a cylindrical developing powder bearing member 102, which rotates opposing an image bearing member 101, a first developing powder accommodating chamber 110 which is located adjacent to the developing powder bearing member 102, accommodates developing powder and supplementary developing powder supplied from a supplementary cartridge 103 located above, and agitates the developing powder with an agitation screw 104 and a second developing powder accommodating chamber 111 which supplies developing powder to the developing powder bearing member 102 with a conveyance screw 105, and the first developing powder accommodating chamber 110 and the second developing powder accommodating chamber 111 are partitioned by a partition wall 106.

As shown in FIG. 7B, the first developing powder accommodating chamber 110 and the second developing powder accommodating chamber 111 communicate with each other at both ends in a rotation direction of the screws 104, 105 and the agitation screw 104 and the conveyance screw 105 which are provided in the first developing powder accommodating chamber 110 and the second developing powder accommodating chamber 111, respectively convey developing powder in opposite directions to each other.

In such a developing apparatus, the supplementary developing powder charged to the surface of developing powder in the first developing powder accommodating chamber 110 from the supplementary cartridge 103 above the first developing powder accommodating chamber 110 is supplied to a position 107 indicated in FIG. 7B and traverses the first developing powder accommodating chamber 110 while being agitated by the agitation screw 104, so that it is charged receiving sufficient frictional electrification in this period. That developing powder flows into the second developing powder accommodating chamber 111 and is supplied to the developing powder bearing member 102 by the conveyance screw 105.

The developing powder supplied to the rotating developing powder bearing member 102 is conveyed into a developing area in the vicinity of the image bearing member 101 and developing powder is transferred to a latent image on the image bearing member 101 by a vibrating electric field so that the latent image is visualized. Developing agent not used for development passes the second developing powder accommodating chamber 111 and is conveyed to the first developing powder accommodating chamber 110 again. Then, circulation of the developing powder is continued so that toner and carrier are mixed within a certain range of uniformity with repeating the supply and agitation.

In such a developing apparatus, developing powder needs to pass the second developing powder accommodating chamber 111 accompanying agitation of the agitation screw 104 in a period since the developing powder is supplied to the first developing powder accommodating chamber 110 by the time when it reaches the developing powder bearing member 102. Particularly initial developing powder is charged sufficiently so that appropriate development can be carried out without fog with appropriately charged developing powder between the developing powder bearing member 102 and the image bearing member 101.

However, with an increase in process speed of copying machines in recent years, supplementary developing powder is scattered within the first developing powder accommodating chamber 110 by a motion of the agitation screw 104 in the conventional developing apparatus structure and in the worst case, the scattered developing agent reaches the image bearing member 101 thereby possibly causing fog. Further, the height of developing powder in the developing apparatus differs due to such environmental difference as temperature and humidity around the developing powder even if the weight of the developing powder is the same. Thus, when the height of the developing powder exceeds the height of the agitation screw 104, the supplementary developing powder moves just as if it slips on the surface of the developing powder without being fetched into the inside of the developing powder and agitated well, and consequently, such a problem that developing powder charged low is conveyed to the developing agent bearing member 102.

In view of the problem with scattering of developing powder inside the developing apparatus, Japanese Patent Application Laid-Open No.2003-107859 has taken a measure for reducing a reaction force generated when developing powder is exchanged between the screws and Japanese Patent Application Laid-Open No.2003-215917 has taken a measure of preventing the scattering of developing powder to the outside of the developing apparatus with an end seal.

Additionally, other countermeasures such as increasing the height of the partition wall 106 which partitions the first developing powder accommodating chamber 110 and the second developing powder accommodating chamber 111 or increasing the quantity of agitation members, called ribs, provided on the side face of the agitation screw 104 have been taken.

However, if considering acceleration of process speed in an image forming apparatus such as a copying machine in recent years, no remarkable effect to the scattering of developing powder in the developing apparatus can be expected even if the height of the wall face is intensified or the quantity of the ribs is increased according to the above-described conventional methods and as a consequence, there is a fear that developing powder charged by insufficient friction may adhere to the developing powder bearing member.

SUMMARY OF THE INVENTION

The present invention has been achieved in view of the above-described problems and an object of the invention is to provide a developing apparatus capable of improving charging efficiency by preventing scattering of developing powder when it is supplied.

To achieve the above described object, there is provided a developing apparatus which develops an electrostatic latent image formed on an image bearing member at a development position, comprising a developing means including, a developing powder accommodating unit which accommodates developing powder, and a screw which is disposed in the developing powder accommodating unit and which agitates and conveys developing powder, and a developing powder bearing member which bears developing powder in said developing powder accommodating unit which develops an image, said developing means can rotate to move between said development position and, a non-development position, and a developing powder supply means which supplies developing powder to the developing powder accommodating unit, wherein said developing powder supply means supplies developing powder to a lower area with respect to said screw in the vertical direction of the developing powder accommodating unit in a posture of said development position.

DETAILED DESCRIPTION OF THE EMBODIMENTS

First Embodiment

A developing apparatus and image forming apparatus according to one embodiment of the present invention will be described with reference to the accompanying drawings.

[Configuration of Whole Image Forming Apparatus]

Figure 1:
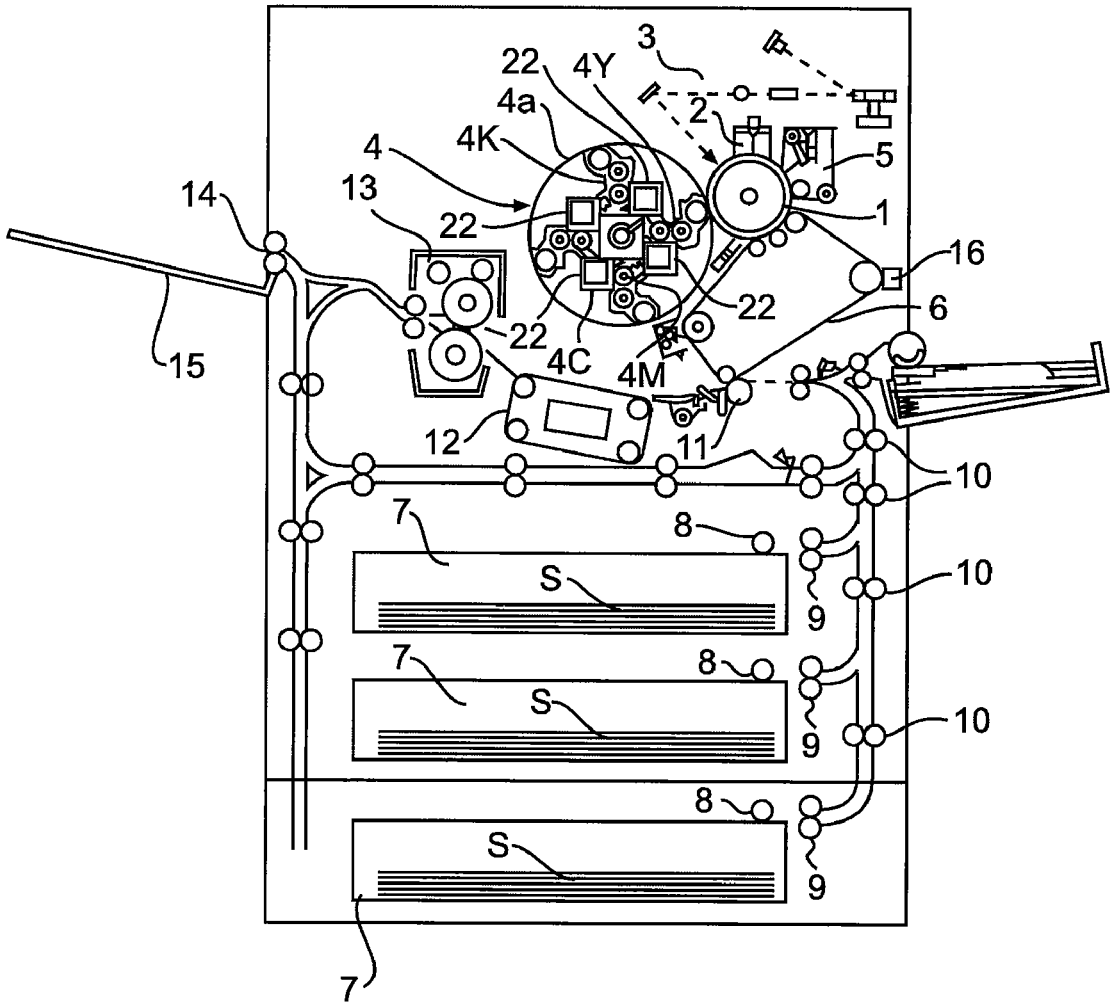
FIG. 1 is an explanatory diagram of an entire section of an image forming apparatus according to a first embodiment.

First, the configuration of the whole image forming apparatus will be described as well as its image forming operation with reference to FIG. 1. FIG. 1 is a schematic sectional diagram of the image forming apparatus.

In the image forming apparatus of this embodiment, four development units are opposed to an image bearing member as four developing means using a developing rotary in succession so as to transfer a developing powder image of different color to an intermediate transfer member successively, thereby forming a color image. Then, this image is transferred to a conveyed recording medium so as to record the color image thereon.

A primary charger 2, an exposure unit 3, a developing apparatus 4 and a cleaning unit 5 are disposed around a photosensitive drum 1 which is an image bearing member. The surface of the rotating photosensitive drum 1 is charged uniformly by the primary charger 2 and by irradiating a laser beam corresponding to an image signal from the exposure unit 3, an electrostatic latent image is formed. That electrostatic latent image is developed by the developing apparatus 4 and then visualized. Then, the developed developing powder image is transferred primarily to an intermediate transfer belt 6, which acts as an intermediate transfer member.

In the aforementioned developing apparatus 4, a rotating rotary 4*a* is loaded with development units 4Y, 4M, 4C, 4K as four developing means which develop respective color developing powders of yellow, magenta, cyan, and black and the respective development units 4Y, 4M, 4C, 4K are opposed to the photosensitive drum 1 successively by a rotation of the rotating rotary 4*a* so that developing powder images of the respective colors are formed successively on the photosensitive drum 1. The respective color developing powder images formed successively on the photosensitive drum 1 are transferred primarily to the intermediate transfer belt 6 which rotates supported by a plurality of supporting rollers such that they overlap each other thereby forming a color image.

Synchronously with the formation of an image, a recording medium S is conveyed to a secondary transfer section from a cassette 7 loaded below of the developing apparatus 4 by a feeding roller 8, a separation roller pair 9, and a conveyance roller pair 10 and then, a bias voltage is applied to a secondary transfer roller 11 as a transfer member so that the aforementioned color image is transferred secondarily to the recording medium S.

After the color image is transferred, the recording medium S is conveyed to a fixing unit 13 by a conveyer belt 12, in which the transferred developing powder image is fixed by heat and then, the recording medium S is discharged to a discharge tray 15 by a discharge roller pair 14.

In the meantime, developing powder left on the photosensitive drum 1 after the developing powder is transferred primarily to the intermediate transfer belt 6 is removed by a cleaning unit 5. Further, developing powder left on the intermediate transfer belt 6 after the developing powder image is transferred secondarily to the recording medium S is removed by a belt cleaning unit 16.

[Developing Apparatus]

Figure 2:
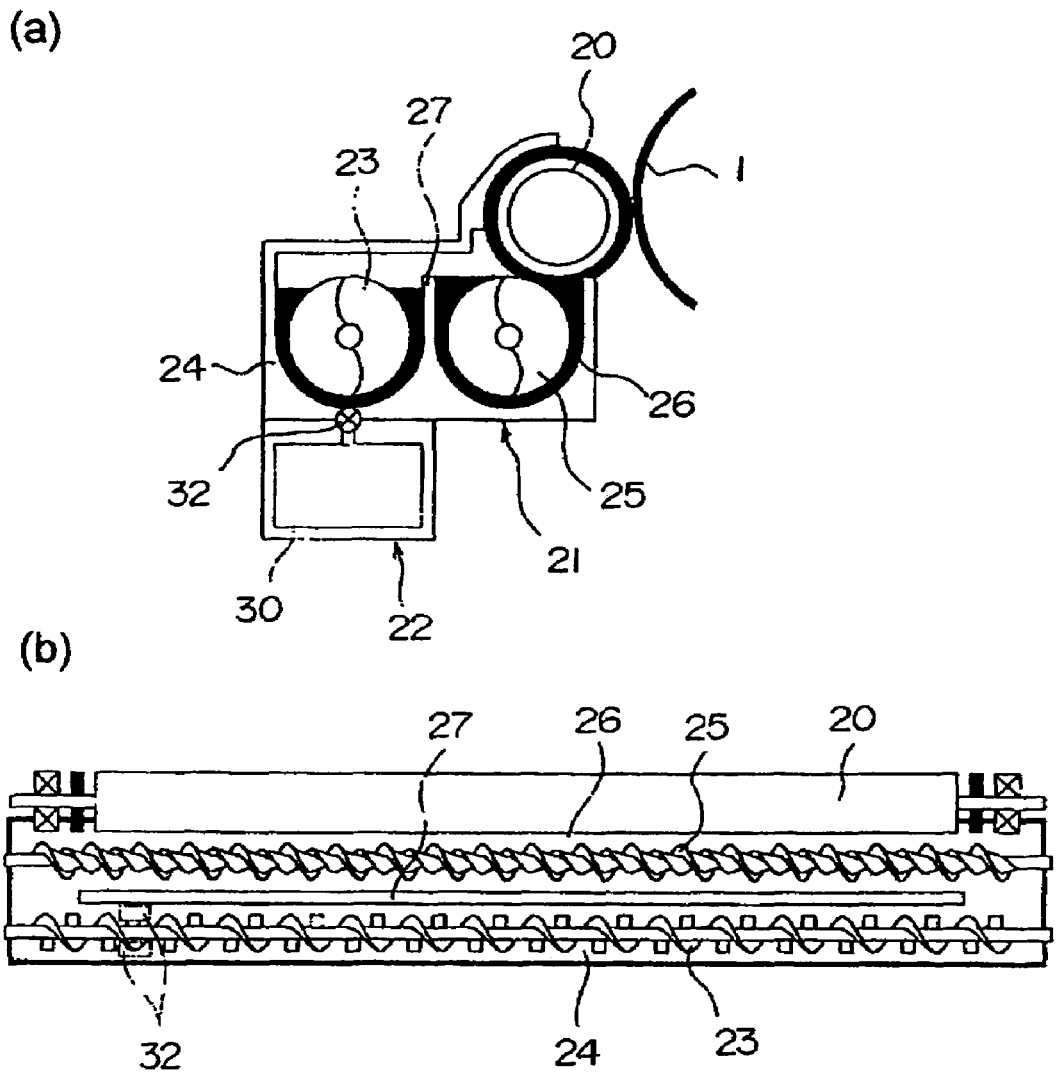
FIG. 2A is an explanatory sectional view of a developing apparatus according to the first embodiment.
FIG. 2B is an explanatory plan view of a developing apparatus according to the first embodiment.

Next, the developing apparatus 4 will be described. FIGS. 2A and 2B are schematic diagrams showing the structure of a developing apparatus of this embodiment. The developing apparatus 4 includes a cylindrical developing powder bearing member 20 which rotates opposing the photosensitive drum 1, a developing powder accommodating means 21 which accommodates developing powder to be supplied to the developing powder bearing member 20 and includes screws for agitating and conveying the developing powder and a developing powder supply means 22 for supplying developing powder to the developing powder accommodating means 21.

The developing powder bearing member 20 conveys developing powder by rotating with the developing powder adhering to the surface of the developing powder bearing member 20 and a position in the vicinity of the photosensitive drum 1 capable of holding an electrostatic latent image on the surface thereof is a developing position of a development unit. A DC superimposed AC voltage is applied to the developing powder bearing member 20 from a developing bias power supply, charged developing powder adheres to the electrostatic latent image on the photosensitive drum 1 by an electric field formed in the aforementioned developing position.

In the developing powder accommodating means 21, there are disposed a first developing powder accommodating chamber 24 which accommodates developing powder and supplementary developing powder supplied from the developing powder supply means 22 located below, agitates and conveys it with an agitation screw 23 and a second developing powder accommodating chamber 26 which supplies developing powder to the developing powder bearing member 20 with a conveyance screw 25 in parallel to each other and the first developing powder accommodating chamber 24 and the second developing powder accommodating chamber 26 are partitioned by a partition wall 27.

As shown in FIG. 2B, the first developing powder accommodating chamber 24 and the second developing powder accommodating chamber 26 communicate with each other at both ends in the direction of a rotational axis of the screws 23, 25. The screws 23, 25 provided inside of each chamber 24, 26 convey developing powder in opposite directions to each other.

The outside diameter ϕ of the agitation screw 23 and the conveyance screw 25 of this embodiment is 16 mm and the outside diameter ϕ of their screw shaft is 6 mm. The screw pitch is 20 mm and particularly, ribs for intensifying developing powder agitation efficiency are provided on the shaft of the agitation screw 23 at a pitch of 10 mm and its size is 4 mm in width and 4 mm in height and they have a crossing angle with respect to the shaft.

According to this embodiment, a gap between the bottom face of the developing powder accommodating chambers 24, 26 and the screws 23, 25 is set to 1.5 mm. Further, the rotational speed of the screws 23, 25 are set to 350 rpm for the conveyance screw 25 and 400 rpm for the agitation screw 23. The revolution speed of the developing powder bearing member 20 rotating in conjunction with these screws 23, 25 is about 220 mm/s and the revolution speed of the photosensitive drum 1 rotating with a certain speed ratio with the developing powder bearing member 20 is set to 130 mm/s.

As a consequence, developing powder in the first developing powder accommodating chamber 24 is agitated and conveyed to the second developing powder accommodating chamber 26 by rotating the screws 23, 25 and then, by supplying developing powder in the second developing powder accommodating chamber 26 to the developing powder bearing member 20, a latent image formed on the photosensitive drum 1 is developed.

Figure 3:
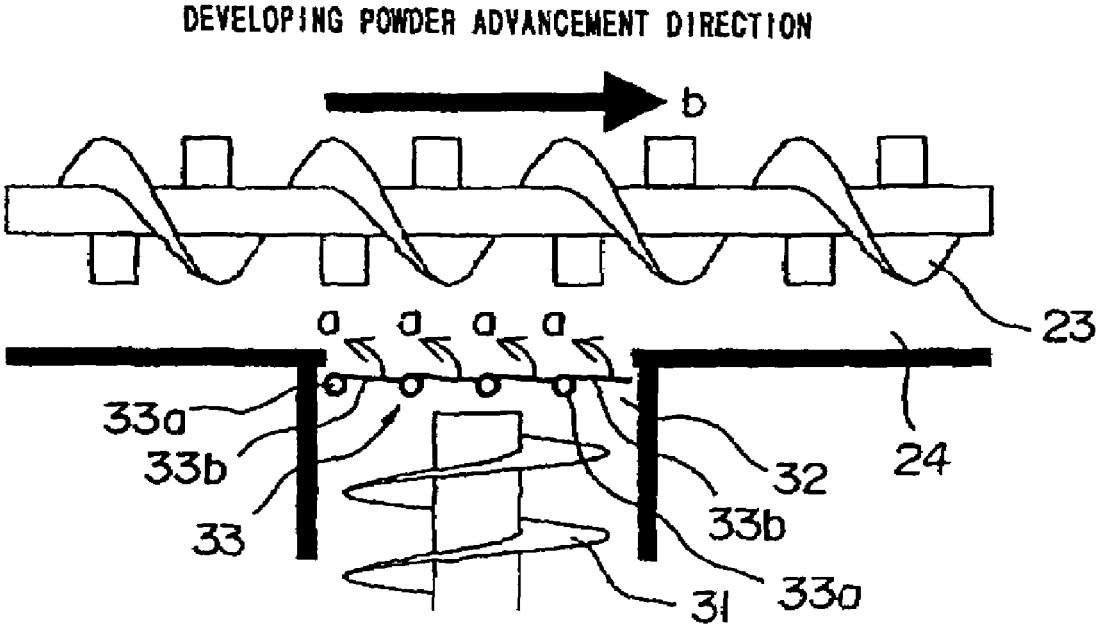
FIG. 3 is an explanatory diagram of the structure of a developing powder supply port.

The aforementioned development unit can be supplied with developing powder by the developing powder supply means 22. This developing powder supply means 22 conveys developing powder in a supplementary developing powder cartridge 30 with a conveyance screw 31 as shown in FIG. 3 and supplies it into the first developing powder accommodating chamber 24 through a supply port 32 provided in the bottom portion of the first developing powder accommodating chamber 24. According to this embodiment, as regards to the supply of developing powder from the supplementary developing powder cartridge 30, the supplementary developing powder cartridge 30 is disposed below the agitation screw 23 in a perpendicular direction at a developing position in which the development unit develops an image on the photosensitive drum 1 and developing powder is pushed out into a lower area than the agitation screw 23 in the perpendicular direction from the supplementary developing powder cartridge 30 by the conveyance screw 31. The quantity of developing powder to be supplied is determined based on the rotation of the agitation screw 23.

The supply port 32 of this embodiment is formed in a rectangular shape 4 mm wide in a direction perpendicular to the direction of the rotational axis of the agitation screw 23 and 12 mm long in a direction parallel thereto and two supply ports 32 are provided in parallel in the direction perpendicular to the direction of the rotational axis of the agitation screw 23.

The supply port 32 of this embodiment is dented 1 mm with respect to its surrounding. As shown in FIG. 3, there is provided a restricting means 33 for restricting movement of developing powder from the side of the first developing powder accommodating chamber 24 to the side of the supplementary developing powder cartridge 30. The restricting means 33 is constituted of valves 33*b* each rotatable around a shaft 33*a*. Although this valve 33*b* is opened by a pushing force when developing powder is pushed out into the first developing powder accommodating chamber 24 by the conveyance screw 31 (arrow a in FIG. 3), when no developing powder is supplied from the supplementary developing powder cartridge 30 located downward in a vertical direction with respect to the first developing powder accommodating chamber 24, the valve 33*b* is pressed in a direction in which it is closed by the weight of first developing powder accommodating in the developing powder chamber 24 thereby restricting the rotational direction of the valve 33*b*. For this reason, although developing powder is supplied from the supplementary developing powder cartridge 30 to the first developing powder accommodating chamber 24, the supplied developing powder never flows back to the supplementary developing powder cartridge 30.

As shown in FIG. 3, the axis of the shaft 33*a* is parallel to the direction perpendicular to the direction of the rotational axis of the agitation screw 23 and as for the relation between the positional relation between the shaft 33*a* and the valve 33*b*, the shaft 33*a* is located upstream with respect to the advancement direction (arrow b in FIG. 3) of developing powder agitated and conveyed by the agitation screw 23 while the rotary end of the valve 33*b* is located downward. Thus, when developing powder is conveyed through the first developing powder accommodating chamber 24 by the agitation screw 23, pressure of conveyed developing powder is applied in a direction of closing the valve 33*b* thereby causing no leakage of developing powder from the supply port 32.

In the meantime, according to this embodiment, the valve 33*b* is formed in a rectangular shape 4 mm wide in the direction perpendicular to the direction of the rotational axis of the agitation screw 23 and 2 mm long in the direction parallel thereto and the valves 33*b* are provided entirely on the supply port 32.

Figure 4:
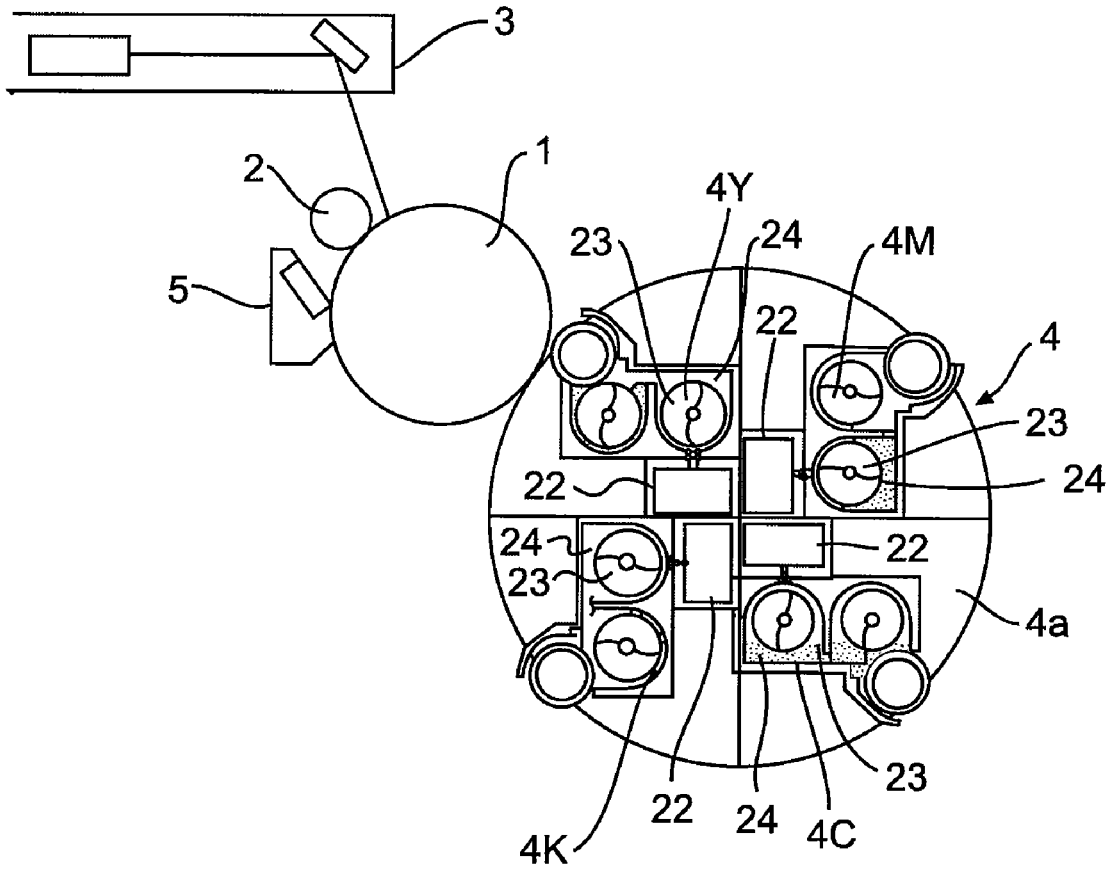
FIG. 4 is an explanatory diagram showing supply of developing powder in a rotary developing apparatus.

As shown in FIG. 4, four development units 4Y, 4M, 4C, 4K are loaded on the rotating rotary 4*a* as described previously and by rotating this rotating rotary 4*a* corresponding to an image formation operation, the four development units 4Y, 4M, 4C, 4K oppose the photosensitive drum 1 successively.

In the rotating rotary type developing apparatus 4, supply of developing powder is carried out when the development unit 4Y, 4M, 4C, 4K is rotated by 180° from a developing position, namely, if speaking about the state of FIG. 4, when the developing apparatus 4 is located at the position of the development unit 4C. If developing powder is supplied when the supplementary developing powder cartridge 30 is located above the first developing powder accommodating chamber 24 in the vertical direction, the supplied developing powder is supplied to the first developing powder accommodating chamber 24 smoothly by its weight. Then, when the development unit 4Y, 4M, 4C, 4K returns to the developing position, the supplied developing powder is covered with developing powder already existing in the first developing powder accommodating chamber 24, so that it comes that supplied developing powder is agitated from a state in which it is buried in the existing developing powder and as a consequence, the supplied developing powder is prevented from being scattered out of the development unit 4Y, 4M, 4C, 4K before it is agitated.

Because the supplied developing powder exists at a lower position in the vertical direction below the agitation screw 23 than developing powder already existing in the first developing powder accommodating chamber 24, even if the height of the developing powder with respect to the agitation screw 23 changes against environment surrounding the developing powder such as humidity and temperature, the supplied developing powder always moves inside the developing powder at an initial stage and thus, the supplied developing powder can be prevented from slipping on the surface of developing powder thereby raising charging efficiency of the supplied developing powder to agitation.

Developing powder supplied to the bottom of the first developing powder accommodating chamber 24, namely, below the agitation screw 23 is agitated by the agitation screw 23 with a high frictional electrification efficiency and then, flows into the second developing powder accommodating chamber 26 including the conveyance screw 25, so that the developing powder is attracted by magnetic force of the rotating developing powder bearing member 20 and conveyed to a development position on the electrostatic latent image.

Although developing powder is supplied when the development unit 4Y, 4M, 4C, 4K is rotated by 180° with respect to the development position because this embodiment adopts a rotation rotary type developing apparatus 4, it may be supplied when it is rotated by an angle other than 180° with respect to the development position. For example, developing powder may be supplied when the development unit 4Y, 4M, 4C, 4K is located at the development position also. However, in case of the rotation rotary type developing apparatus 4, it is more preferable that developing powder is supplied when the development unit 4Y, 4M, 4C, 4K is located at a non-development position rather than it is located at the development position because the developing powder can be supplied more smoothly by its own weight.

Second Embodiment

The apparatus according to the second embodiment will be described with reference to FIG. 5. Because the basic structure of the apparatus of this embodiment is the same as the above-described embodiment, any duplicated description is not shown and the feature structure of this embodiment will be described. Like reference numerals are attached to components having the same function as the above-described embodiment.

Figure 5:
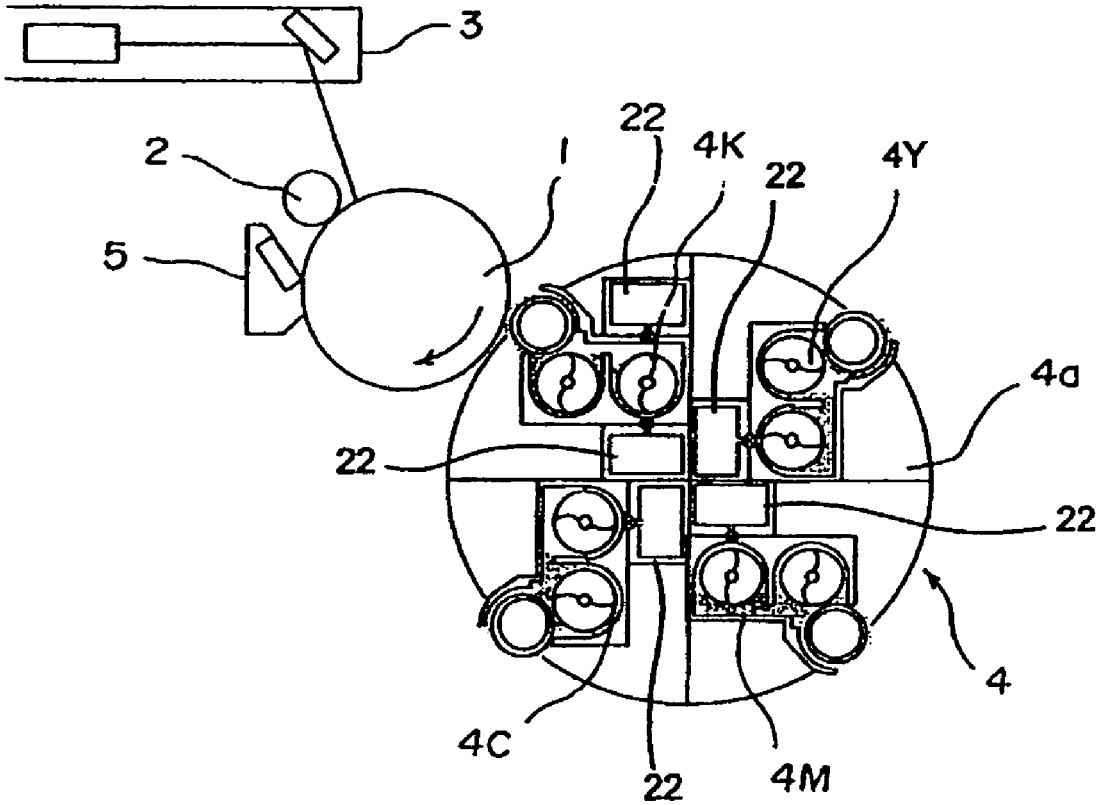
FIG. 5 is an explanatory diagram of a second embodiment in which only a black development unit is provided with two developing powder supply means.

According to this embodiment, as shown in FIG. 5, of the four development units 4Y, 4M, 4C, 4K, only the black development unit 4K used most frequently is provided with the developing powder supply means 22 having the supplementary developing powder cartridge 30 not only below the agitation screw 23 in the vertical direction when the development unit 4K is located at the development position but also above the agitation screw 23 in the vertical direction. As a consequence, even if development supply only in the color black continues, the rotating rotary 4*a* does not need to be rotated each time but development can be carried out without interrupting the image formation activity.

Meanwhile, although this embodiment shows an example in which two developing powder supply means 22 are provided for only the black development unit 4K, it is permissible to provide two developing powder supply means 22 for other development units 4Y, 4M, 4C.

Third Embodiment

Next, the third embodiment of the present invention will be described with reference to FIG. 6. Because the basic structure of the apparatus of this embodiment is the same as the above-described embodiment, any duplicated description is not shown and the feature structure of this embodiment will be described. Like reference numerals are attached to components having the same function as the above-described embodiment.

Figure 6:
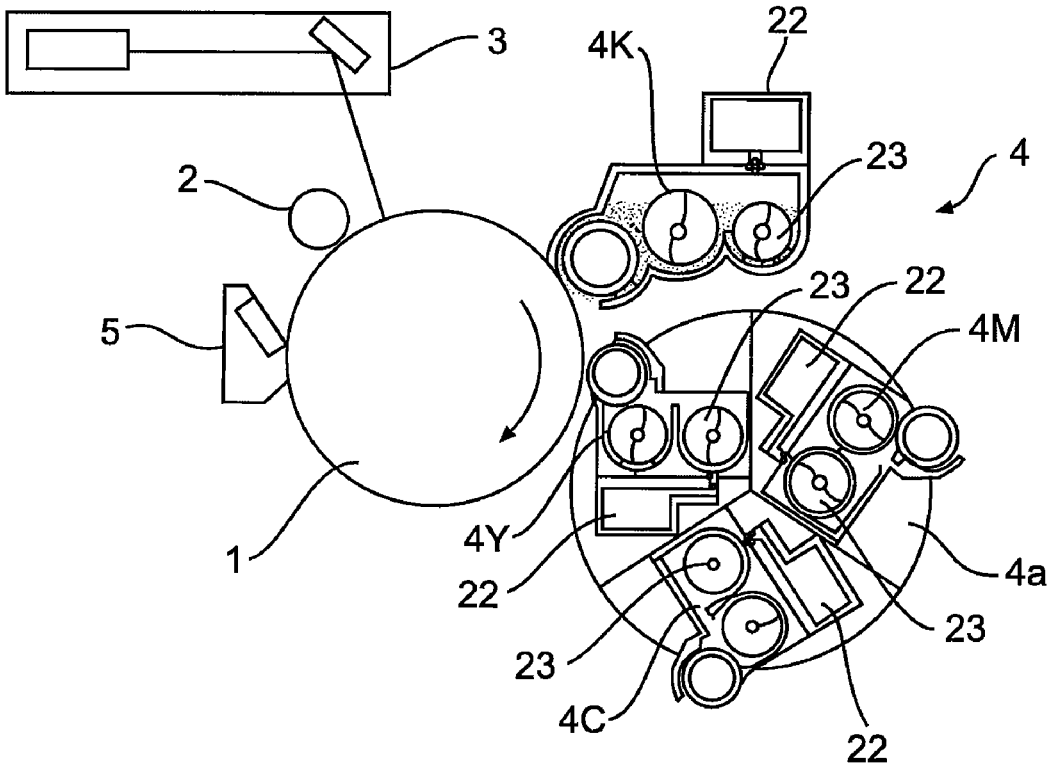
FIG. 6 is an explanatory diagram of a third embodiment in which a black development unit is fixed to a photosensitive drum.

According to this embodiment, as shown in FIG. 6, three development units, yellow development unit 4Y, magenta development unit 4M and cyan development unit 4C, are loaded on the rotating rotary 4*a* and rotated so as to be opposed to the photosensitive drum 1. However, the black development unit 4K used most frequently is not constructed to be rotatable but formed as a development unit fixed to the photosensitive drum 1.

Supply of developing powder to the first developing powder accommodating chamber 24 of each of the three development units 4Y, 4M, 4C constituting the rotary developing apparatus 4 can be carried out by the developing powder supply means 22 from an area below the agitation screw 23 in the vertical direction when the development unit 4Y, 4M, 4C is located at a development position. On the other hand, supply of developing powder to the first developing powder accommodating chamber 24 in the black development unit 4K as a fixed development unit can be carried out from an area above the agitation screw 23 in the vertical direction by the developing powder supply means 22.

In this case, the black development unit 4K in which developing powder is supplied from the side above the agitation screw 23 in the vertical direction, does not need to be equipped with the previously mentioned restricting means 33 for preventing a back flow of developing powder.

By using only colors which have a low usage frequency as a single color as those loaded on the rotary developing apparatus 4, supply of developing powder with an excellent agitation efficiency and development of an image can be carried out more smoothly.

CROSS-REFERENCE TO RELATED APPLICATION

This application claims the benefit of priority from the prior Japanese Patent Application No. 2004-352496 filed on Dec. 6, 2004 the entire contents of which are incorporated by reference herein.

What is claimed is:

1. A developing apparatus which develops an electrostatic image formed on an image bearing member at a development position, comprising:

a developing device including, a developing powder accommodating unit which accommodates developing powder, and a screw disposed in said developing powder accommodating unit which agitates and conveys developing powder, and a developing powder bearing member which bears developing powder in said developing powder accommodating unit which develops the electrostatic image, said developing device being rotatable to move between the development position and a non-development position; and a developing powder supply device which supplies developing powder to said developing powder accommodating unit, wherein said developing powder supply device supplies developing powder to a lower area with respect to said screw in the vertical direction of said developing powder accommodating unit in a posture of the development position.

2. The developing apparatus according to claim 1, wherein said developing powder accommodating unit comprises a first developing powder accommodating chamber having a screw which agitates developing powder supplied from said developing powder supply device and a second developing powder accommodating chamber having a screw which conveys developing powder sent from said first developing powder accommodating chamber to said developing powder bearing member.

3. The developing apparatus according to claim 1, further comprising:

a plurality of developing devices including, a plurality of developing powder accommodating units which accommodate developing powder; and a plurality of developing powder supply devices which supply developing powder to said developing powder accommodating units, wherein developing is processed by each developing device when positioned at the development position, and wherein said developing powder supply devices supply developing powder to said developing powder accommodating units of said developing devices at the non-development position.

4. The developing apparatus according to claim 3, wherein the non-development position is a position where said developing device rotates 180° from the development position.

5. The developing apparatus according to claim 3, wherein of said plurality of the developing devices, at least one developing device is capable of being supplied with developing powder from both the lower area and an upper area in said developing powder accommodating unit.

6. The developing apparatus according to claim 1, further comprising:

a rotary body on which said developing device is mounted; and a fixed developing device which is fixed to be disposed at a position near said image bearing member, including a fixed developing powder accommodating unit, wherein said developing powder accommodating unit of said developing device is capable of being supplied with developing powder from the lower area, and wherein said fixed developing powder accommodating unit of said fixed developing device is capable of being supplied with developing powder from an upper area in the vertical direction.

7. The developing apparatus according to claim 1, wherein a supply port which supplies developing powder from said developing powder supply device to said developing powder accommodating unit is provided with a restricting mechanism which restricts movement of developing powder from said developing powder accommodating unit to said developing powder supply device.

8. The developing apparatus according to claim 1, wherein supply of developing powder from said developing powder supply device to said developing powder accommodating unit is carried out by rotating the screw and the quantity of developing powder to be supplied is adjustable by adjusting a revolution speed of the screw.

9. A developing apparatus which develops an electrostatic image formed on an image bearing member at a development position, comprising:

a developing device including, a developing powder accommodating unit which accommodates developing powder, and a screw disposed in the developing powder accommodating unit which agitates and conveys developing powder, and a developing powder bearing member which bears developing powder in said developing powder accommodating unit which develops an electrostatic image, said developing device being rotatable to move between the development position and a non-development position; and a developing powder supply device which supplies developing powder to said developing powder accommodating unit when said developing device is not in the development position, wherein said developing powder supply device supplies developing powder to a lower area with respect to said screw in a vertical direction of the developing powder accommodating unit in a posture of the development position.

* * * * *

UNITED STATES PATENT AND TRADEMARK OFFICE

CERTIFICATE OF CORRECTION

Figure 7A:
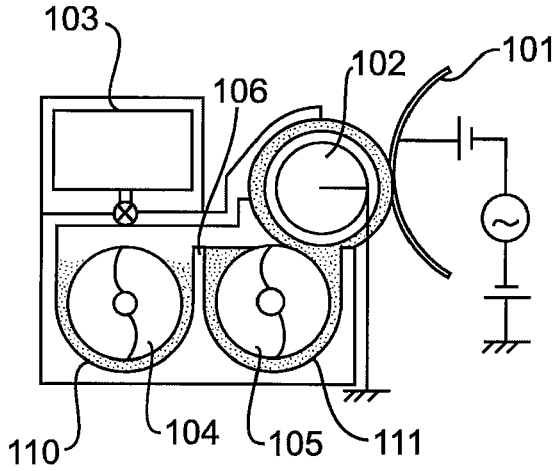
FIG. 7(a) PRIOR ART
FIG. 7 is an explanatory diagram of a developing apparatus according to the conventional art.
Figure 7B:
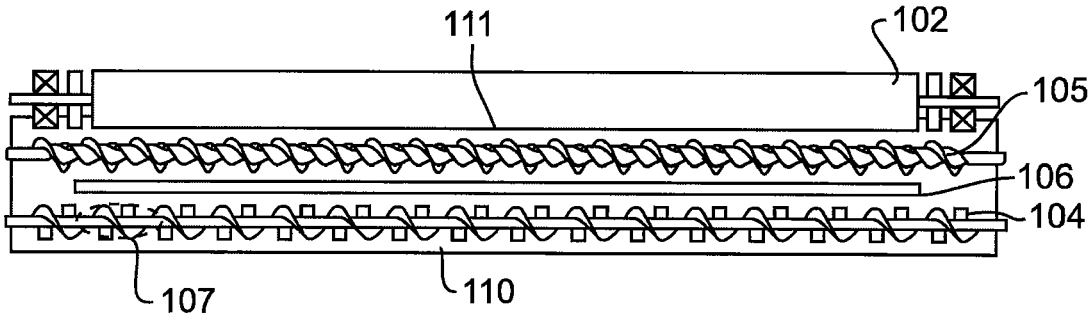
FIG. 7(b) PRIOR ART

PATENT NO. : 7,391,995 B2
APPLICATION NO. : 11/281397
DATED : June 24, 2008
INVENTOR(S) : Ryota Fujioka It is certified that error appears in the above-identified patent and that said Letters Patent is hereby corrected as shown below:

COLUMN 1:
Line 16, "FIG. 7" should read --FIG. 7(a)--.

COLUMN 3:
Line 3, "and," should read --and--.

COLUMN 4:
Line 13, "of the" should read --the--.

COLUMN 5:
Line 60, "dented" should read --recessed--.

COLUMN 8:
Line 43, "including," should read --including--.

COLUMN 9:
Line 5, "including," should read --including--.

COLUMN 10:
Line 19, "including," should read --including--.

Signed and Sealed this

Tenth Day of February, 2009

John Doll

JOHN DOLL
*Acting Director of the United States Patent and Trademark Office*